United States Patent [19]

Elder et al.

[11] 4,402,492

[45] Sep. 6, 1983

[54] BURNER APPARATUS FOR MOLTEN METAL FUME SUPPRESSION

[75] Inventors: Arthur L. Elder, Spanish Fork; Mack R. Ostergaard, Pleasant Grove; Dennis R. Smith, Lindon; Reed H. Warner, Spanish Fork, all of Utah

[73] Assignee: United States Steel Corporation, Pittsburgh, Pa.

[21] Appl. No.: 389,632

[22] Filed: Jun. 16, 1982

[51] Int. Cl.[3] ..... C21B 7/14

[52] U.S. Cl. ..... 266/196; 75/46; 75/96; 239/424.5; 239/524; 266/206; 266/236; 432/23

[58] Field of Search ..... 266/207, 195, 196, 236, 266/261; 239/418, 424.5, 429, 524; 432/23, 225; 431/354; 75/96; 164/66.1, 67.1, 68.1, 124, 259, 415

[56] References Cited

U.S. PATENT DOCUMENTS

| | | | |
|---|---|---|---|
| 2,821,760 | 2/1958 | Kurzinski | 164/124 |
| 3,863,907 | 2/1975 | Pierson, Sr. et al. | 266/196 |
| 3,917,242 | 11/1975 | Bass et al. | 266/207 |

*Primary Examiner*—M. J. Andrews
*Attorney, Agent, or Firm*—John F. Carney

[57] ABSTRACT

Apparatus is described that is particularly adapted for suppressing fume generated in the flow of molten metal through the runner system of a blast furnace cast house. Burners adapted for combusting fuel and air are disposed at longitudinally spaced locations along the runner system. Fuel and air in predetermined amounts are discharged from the burners to create flame and disperse it along the axis of the runners. The flame operates to consume ambient air in the combustion process thereby to starve the region over the metal streams of oxygen that would otherwise combine with metal vapors to create fume-producing metallic oxides.

7 Claims, 4 Drawing Figures

BURNER APPARATUS FOR MOLTEN METAL FUME SUPPRESSION

BACKGROUND OF THE INVENTION

The present invention pertains to the suppression of undesirable fugitive emissions that is prevalent in the production of molten metal, particularly that of iron or steel.

When molten metals are subjected to turbulent flow as, for example, molten iron in flowing along a runner system between a blast furnace and a tapping ladle a significant amount of undesirable fume is generated that constitutes a serious atmospheric pollution problem, the abatement of which represents a substantial part of the cost of performing the process. Much effort and expense has been expended in the development of emission control systems effective to maintain the volume of this fugitive fume within acceptable limits. Past efforts have been primarily directed toward the development of systems that collect the fume after it has been generated and conduct it to treating apparatus for cleaning it prior to its discharge into the atmosphere. Such systems, while been effective to a limited degree in solving the concerned problem, are expensive to install and costly to operate.

More recently, however, developments have been made in apparatus that is effective to dispense with the need for fume collection and treatment apparatus by preventing the formation of fume in the first instance. Such apparatus is described in Japanese Pat. No. 53-6602, granted Mar. 9, 1978 to Nippon Steel Corporation in which fume is suppressed by blanketing the molten bath with inert gases, such as steam or nitrogen. U.S. patent application Ser. No. 286,395, filed July 23, 1981 by Ball et al teaches fume suppression by injecting a mixture of water and inert gas over the molten bath in a receiver. U.S. patent application Ser. No. 325,460 filed Nov. 27, 1981 by Billings et al describes a comparable system in which fuel is burned over the molten bath in order to consume the ambient air and thereby deprive the bath of air available for fume formation.

Belgian Pat. No. 889,880 issued Dec. 1, 1981 to Vajda describes a fume suppression system suitable for use on the pouring trough and runner system of a blast furnace cast house. According to the teachings of this patent, the pouring trough and the iron and slag runners are covered by various devices including mechanical covers, blankets of inert gas, and other elements in order to isolate the molten streams flowing therein from ambient air. The use of such devices, however, are not completely desirable for various reasons. Mechanical covers suitable for this use are large, heavy members that require frequent removal and replacement. This need to frequently move the covers is costly in the time and effort involved. The need to frequently repair and/or replace the covers represents a significant operating expense. Moreover, such movement of the covers disturbs the seal required between the cover edges and the runners thereby creating a danger of air leakage at the respective interfaces between the covers and the runners which renders the system ineffective. Additionally, the provision of inert gas ejector manifolds over the length of the runners, besides being subject to damage caused by excessive heating, are also prone to failure due to molten metal splattering that, over time, causes the ejector opening to plug.

It is to the amelioration of the above problems and toward the provision of a more suitable molten metal fume suppression apparatus for use over blast furnace cast house runners that the present invention is directed.

SUMMARY OF THE INVENTION

There is thus provided according to the invention fume suppression apparatus for suppressing the emission of fume from an open receiver vessel into which molten metal is transferred comprising a fluid fuel burner adapted for positioning in close superposed relation to the surface of the metal in said receiver, said burner including means for discharging fluid fuel into said receiver in wiping relation with the surface of the molten bath therein, said fuel being discharged in amounts sufficient to combine with ambient air in the region of said bath surface for combustion.

It is, accordingly, a particular object of the invention to provide apparatus effective for preventing the emission of metallic oxide fume from elongate molten metal conveyors.

It is another object of the invention to provide apparatus particularly effective for preventing metallic oxide fume emission from a blast furnace runner system.

A further object of the invention is to provide apparatus effective to prevent contact of ambient air with the streams of molten metal flowing in the runner system of a blast furnace cast house thereby to suppress the emission of oxide fumes.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
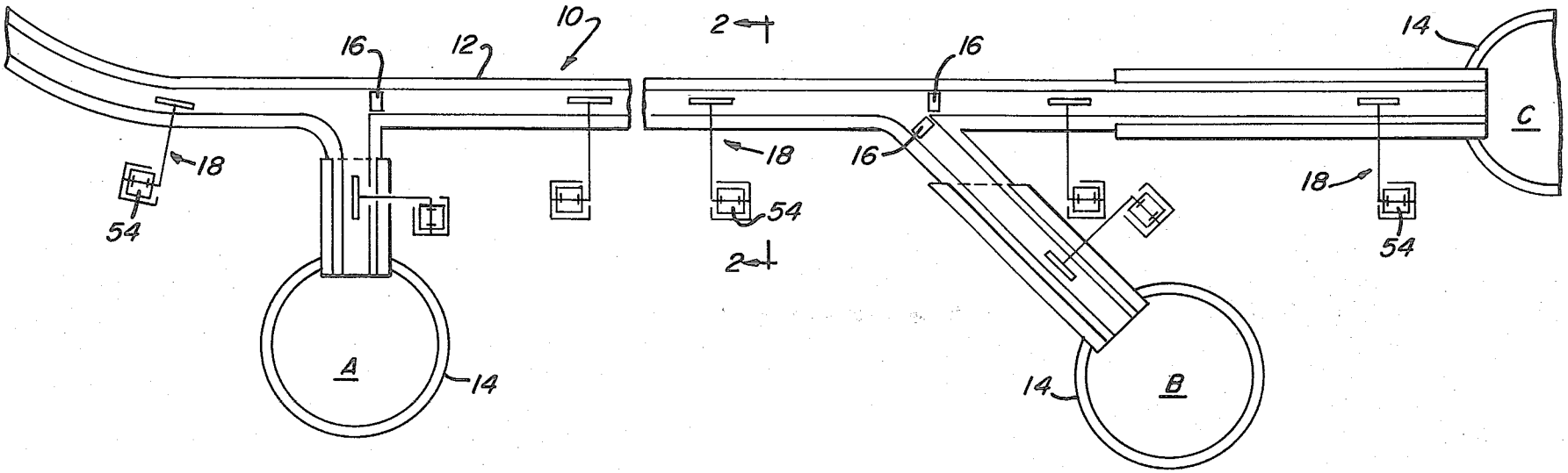
FIG. 1 is a schematic representation of a blast furnace runner system incorporating fume suppression apparatus of the present invention.

FIG. 1 illustrates schematically a system 10 of runners 12 for conducting molten metal from a process furnace, typically a blast furnace (not shown), to receiver ladles 14, for which the fume suppression apparatus of the present invention is particularly adapted for application. Only so much of the molten metal processing system is shown as is necessary for an understanding of the invention. Not shown is the furnace trough which discharges the molten burden from the furnace into the runner system or the skimmer and slag runner system that operates to segregate the pig iron product conducted by the runners 12 from the slag which, as is well known, is a by-product of the production process. It should be understood however, that the invention described herein is equally adaptable for application to a blast furnace trough and to the slag runners as well as to any other elongated conductor of molten metal from which oxide fume may emanate. Removable gates 16 as shown in FIG. 1 enable the discharge of molten pig iron from the furnace sequentially into the ladles 14, indicated as A, B & C, respectively.

As is well known, the flow of molten metal from a blast furnace, or the like, along a runner system is accompanied by the generation of undesirable oxide fume from the surface of the flowing metal. Such fume comprises essentially finely divided oxide particles of the metal being conducted through the runners and creates a polluting atmosphere in the surrounding area. A comprehensive description of the mechanism involved in the generation of fume from systems of the type described herein is contained in the paper, "The Formation of Iron Oxide Fume", by E. T. Turkdogan, et al., Journal of Metals, July 1962.

Figure 2:
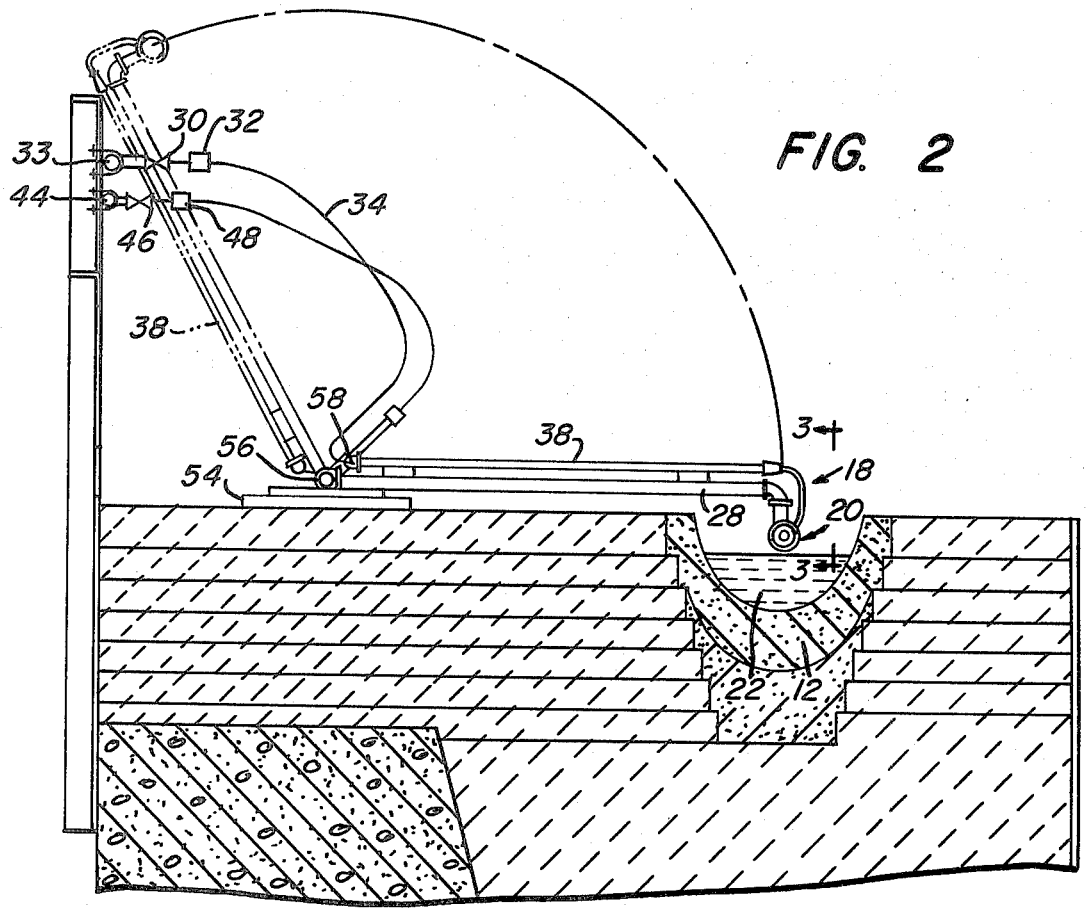
FIG. 2 is an elevational section taken along line 2—2 of FIG. 1.
Figure 4:
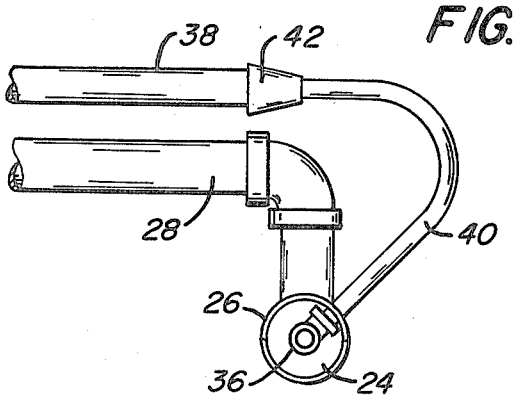
FIG. 4 is an end view of the burner apparatus of FIG. 3.
Figure 3:
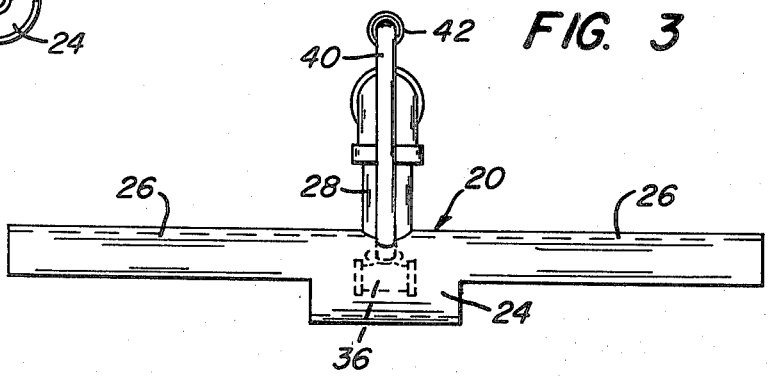
FIG. 3 is an enlarged view of the burner apparatus of the present invention taken along line 3—3 of FIG. 2.

According to the present invention, apparatus is provided that is operative to abate this problem by the consumption of ambient air from the region of the metal flowing in the respective runners 12 thereby to starve the metal of oxygen and, concomitantly, prevent the generation of oxide fume. Such apparatus comprises fuel burner assemblies, identified respectively as 18 in the drawings, disposed at longitudinally spaced locations along the runner system. As best shown in FIGS. 2, 3 and 4 each of these burner assemblies 18 comprises a burner head 20 adapted to be disposed in close, overlying relation to the molten bath 22 flowing in the runners 12. The burner head 20 is conveniently formed of a horizontally extending, generally cylindrical member defining a cylindrical, open ended mixing chamber 24 having concave, downwardly directed baffle structures 26 emanating from each end thereof. A fuel supply pipe 28 is weldedly connected to the head 20 with its discharge end communicating with the mixing chamber 24. The other end of the supply pipe 28 is connected via shut off valve 30 and a flow regulator 32 with a source 33 of gaseous fuel, preferably natural gas. In the arrangement illustrated in FIG. 2, a flexible hose 34 is provided between the regulator 32 and the pipe 28 in order to accommodate pivotal displacement of the burner assembly 18 away from the runner 12 as hereinafter described.

Within the mixing chamber 24 is positioned a T-shaped fitting 36 adapted for the axial discharge of pressurized air along the burner head 20. As shown, the fitting 36 is open at both ends and is disposed in substantial concentrically spaced relation to the interior wall of the mixing chamber 24 adjacent the discharge end of the fuel supply pipe 28. Air under pressure is supplied to the fitting 36 through air supply pipe 38 and line 40, the latter being connected to the former via reducing fitting 42. As shown, the line 40 penetrates the burner head 20 to connect with the upstanding opening of the T-fitting 36. The other end of the air supply pipe 38 connects with a source 44 of pressurized air through shut-off valve 46 and flow regulator 48. A flexible hose 50, similar to hose 34, connects the pipe 38 with the regulator 48 in order to accommodate pivotal movement of the burner assembly 18.

In erecting the burner assembly 18, the supply pipes 28 and 38 are parallelly disposed and connected by braces or brackets 52 in order to be moved in unison from the assembly's operative position over the runner 12. This is desirable in order to have unobstructed access to the runner for its maintenance or repair. Pivoting of the assembly 18 is accomplished in the described apparatus by mounting the ends of the supply pipes 28 and 38 opposite the burner head 20 on a pad 54 laterally removed from the runner 12 by means of swivel unions 56, 58, or the like.

The operation of the hereindescribed fume suppression apparatus is as follows. With the burner assemblies 18 disposed over the runners 12 as shown in the solid lines in FIG. 2 and prior to the flow of molten metal through the runner system, fuel is admitted to all of the burners in amounts just sufficient to sustain a flame, the ignition of which is obtained by igniter apparatus (not shown). Thereafter, as molten metal is discharged from the blast furnace into the runner system, pressurized air is admitted to each burner assembly in sequence so as to increase the intensity of the flame and expel it outwardly from both ends of the respective burner heads 20 over the adjacent region of the runners 12. It has been determined that with fuel in the form of natural gas available at pressures of up to 8 psi and air available at pressures from 70 to 90 psi flame can be expelled from each burner assembly approximately seven to eight feet from each end of the mixing chamber 24 thereby permitting fume suppression along the entire runner system with burner assemblies disposed on approximately fifteen feet spacing.

It will be appreciated that the flame with unconsumed gas that is expelled over the runner system is operative to combine with the ambient air within the runners 12 thereby consuming the air and starving the metal vapors of available oxygen from which to generate metallic oxides and, concomitantly, in this way, the oxide fumes that would otherwise emerge from the surface of metal flowing along the runners is suppressed.

It should further be appreciated that although the fume suppression apparatus disclosed herein is described in connection with their use over the metal-conducting runners in a blast furnace cast house, such apparatus has comparable utility when disposed over a blast furnace trough which as is well known conducts the molten burden, upon tapping, from the furnace to the runners. The apparatus may also be utilized over slag runners that conduct slag separated from the material discharged from the trough to disposal.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. In a system in which molten metal is conducted along elongated runners from a source to a receiver and in which said runners are open to the atmosphere, burner apparatus operative to suppress the emission of fume from the surface of the metal flowing in said runners, said burner apparatus comprising:

a body having a fuel discharge opening directed to discharge fluid fuel for combustion in a direction substantially parallel and in close proximity to the surface of the molten metal flowing in said runner;

means for discharging fluid fuel from said opening in amounts sufficient to combine with ambient air in the region of said metal surface for combustion; and means for dispersing said fluid fuel in an expansive pattern to cover an extended region of said metal surface.

2. Apparatus as recited in claim 1, in which said fuel-dispersing means comprises means for discharging air under pressure in intimate relation with the discharged fuel.

3. Apparatus as recited in claim 2 in which said fluid fuel is gaseous.

4. Apparatus as recited in claim 2 in which said burner comprises:

an elongated burner head defining a baffle structure substantially open in facing relation to the surface of said molten metal and a mixing chamber intermediate the ends of said baffle structure;

a fuel supply pipe communicating with said mixing chamber; and means within said mixing chamber for dispersing fuel longitudinally of said baffle structure, said means including means for discharging pressurized air into intimate, mixing relation with said fuel and for directing the same longitudinally of said baffle structure.

5. Apparatus as recited in claim 4 in which said burner head comprises a generally cylindrical mixing chamber open at its ends and said baffle structure includes downwardly directed arcuate plates emanating from each end of said mixing chamber, said fuel supply pipe attaching to said burner head in communication with said mixing chamber and said fuel dispersing means having a T-shaped body concentrically spaced from the wall of said mixing chamber and disposed adjacent the discharge end of said fuel supply pipe, said T-shaped body being open at its ends and means for connecting said body with a source of pressurized air.

6. In a system in which molten metal is conducted along runners from a furnace to a ladle, means for suppressing the emission of fume from said runners including fuel combusting burners disposed at longitudinally spaced locations along said runners, each of said burners comprising:

an elongated burner head in overlying relation to the surface of the molten metal flowing in said runners;

said burner head including a generally cylindrical open-ended mixing chamber having its axis disposed generally parallel to the subjacent runner;

a baffle structure including downwardly concave plates emanating from each end of said mixing chamber;

a fuel supply pipe attached to said burner head with its discharge end in communication with said mixing chamber;

a T-shaped body concentrically spaced from the wall of said mixing chamber and disposed adjacent the discharge end of said fuel supply pipe, said body being open ended and substantially coaxially disposed with respect to said mixing chamber, and means for supplying pressurized air to said T-shaped body.

7. Apparatus as recited in claim 6 in which said fuel is gaseous.

* * * * *